United States Patent [19]

Williams, III et al.

[11] Patent Number: 4,597,124

[45] Date of Patent: Jul. 1, 1986

[54] METHOD AND APPARATUS FOR CLEANING UPHOLSTERY

[76] Inventors: Robert C. Williams, III, 11309 Derby Dr., Raleigh, N.C. 27612; N. Bruce Unruh, 1105 Radley Dr., West Chester, Pa. 19380

[21] Appl. No.: 686,419

[22] Filed: Dec. 26, 1984

[51] Int. Cl.[4] ..... D06M 1/00

[52] U.S. Cl. ..... 8/158; 134/6; 15/320

[58] Field of Search ..... 134/6, 10, 21, 26, 30, 134/37; 68/222, 158; 15/320, 321, 344, 345, 346, 347, 356, 363, 40, 45, 1.5 A; 8/158

[56] References Cited

U.S. PATENT DOCUMENTS

| | | | |
|---|---|---|---|
| 3,397,517 | 8/1968 | De Vigan | 15/344 |
| 3,964,925 | 6/1976 | Burgoon | 134/21 |
| 4,213,224 | 7/1980 | Miller | 15/344 |
| 4,454,627 | 6/1984 | Simm et al. | 15/344 |
| 4,542,557 | 9/1985 | Levine | 15/344 |

*Primary Examiner*—Richard V. Fisher
*Assistant Examiner*—Sharon T. Cohen
*Attorney, Agent, or Firm*—Mills and Coats

[57] ABSTRACT

The present invention relates to a method and apparatus for cleaning upholstery which involves minimal risk of dye bleeding and which is reasonably effective. The invention uses a hand-held applicator and a remote unit. A jet nozzle on the hand-held applicator sprays cleaning solution onto the upholstery. Secured adjacent to the jet nozzle is a brush which imparts mechanical energy to the upholstery and aids in cleaning. Disposed above the brush is a vacuum head that removes the cleaning solution from the upholstery. Air is induced into the vacuum head by a blower secured within the remote unit. The air effectively lifts the cleaning solution from the upholstery and carries the cleaning solution into the vacuum head. Once inside the vacuum head, the combined mixture of air and cleaning solution is directed through a hose into a recovery tank secured within the remote unit where the air and cleaning solution are separated. The blower removes the air from the recovery tank and directs the same back to a dry air manifold secured to the hand-held applicator. As the air moves from the recovery tank to the dry air manifold, the upholstery is heated and dryed. Once inside the dry air manifold the air is directed onto the upholstery through an outlet disposed above and adjacent to the vacuum head for drying the upholstery. Thus an area of upholstery is cleaned and dryed in a single swath of the hand-held applicator.

14 Claims, 3 Drawing Figures

METHOD AND APPARATUS FOR CLEANING UPHOLSTERY

FIELD OF INVENTION

The present invention relates to methods and apparatuses for cleaning upholstery and particularly to methods and apparatuses for cleaning upholstery adapted to be used by professional cleaners.

BACKGROUND OF INVENTION

The method used by professional upholstery cleaners is of necessity rather technical so as not to result in dye bleeding on expensive upholstered furniture. The problem involved in cleaning upholstery revolves around the fact that numerous types of upholstery exist in which varying strengths of cleaning solutions are needed. Determining the specific strength of cleaning solution needed to clean a single piece of furniture requires testing various strength solutions on hidden portions of the upholstery. After applying the solution to a hidden portion of the furniture, it is necessary to wait up to twenty minutes to determine whether dye bleeding will occur. It is obvious that this trial and error method can become quite time consuming. Moreover, the testing requires knowledge of different types of materials and cleaning solutions in order to determine the proper solution needed.

However, there is often a high rate of turnover among upholstery cleaners. A newly hired worker may stay in this job for only six months. This is insufficient time for adequately training the individual. Nevertheless, such inadequately trained individuals are frequently sent into the field to clean furniture because of the demand for these services. Because one worker may be able to clean up to fifteen pieces a day, the potential liability of the cleaning service due to dye bleeding caused by such an individual can be prohibitive. Thus a simple method and apparatus for cleaning upholstered furniture which involves a standardized procedure that can be followed by unskilled workers and which is relatively safe, meaning without any dye bleeding, and which is reasonably effective is needed.

SUMMARY AND OBJECTS OF INVENTION

The present invention relates to a method and apparatus for cleaning upholstery. Provided is a hand-held applicator and a remote support unit. A jet on the hand-held applicator sprays a cleaning solution onto the upholstery. A brush is secured to the applicator adjacent to the jet for brushing the solution into the upholstery. Once the solution is brushed into the upholstery, a vacuum head passes over the upholstery. A blower in the remote support unit pulls air into the vacuum head effectively lifting a combined mixture of air and solution including dirt, debris, etc. The mixture is directed to a recovery tank disposed within the support unit. Once inside the recovery tank, the solution falls out into the tank where it is held and the air is pulled into the blower. The blower directs the air back to a dry air manifold on the hand-held applicator. As the air moves toward the dry air manifold, the same is heated imparting to it a greater drying capacity. Once inside the manifold the air is directed back down onto the upholstery immediately after the solution is removed therefrom by the vacuum head. Thus, the upholstery can be cleaned and dryed in a single swath of the hand-held applicator.

Accordingly, it is the object of the present invention to provide a method and apparatus for cleaning upholstery which is safe, meaning without dye bleeding, and which is reasonably effective.

Another object of the invention is to achieve the preceding object with a method and apparatus that are particularly designed to be used in conformity with a standardized procedure so that the same can be used by unskilled workers.

Another object of the invention is to provide a hand-held applicator having a jet nozzle for applying cleaning solution to a selected area of upholstery.

Yet another object of the present invention is to provide hand actuated control means associated with said hand-held applicator for controlling the flow of solution through said jet nozzle.

A further object of the invention is to incorporate brush means into said hand-held applicator to loosen dirt and debris and to aid in cleaning.

A further object of the invention is to incorporate vacuum means associated with said applicator for lifting said cleaning solution and associated dirt and debris from the upholstery.

A further object of the invention is to incorporate drying means associated with said hand-held applicator for drying the upholstery after the solution is removed therefrom by said vacuum means.

Still another object of the invention is to achieve the preceding object by directing heated air onto the upholstery.

Still another object of the invention is to use a single blower associated with said vacuum means and said drying means.

Other objects and advantages of the invention will become apparent from a review of the following description and accompanying drawings which are merely illustrative of the invention.

DESCRIPTION OF INVENTION

Figure 1:
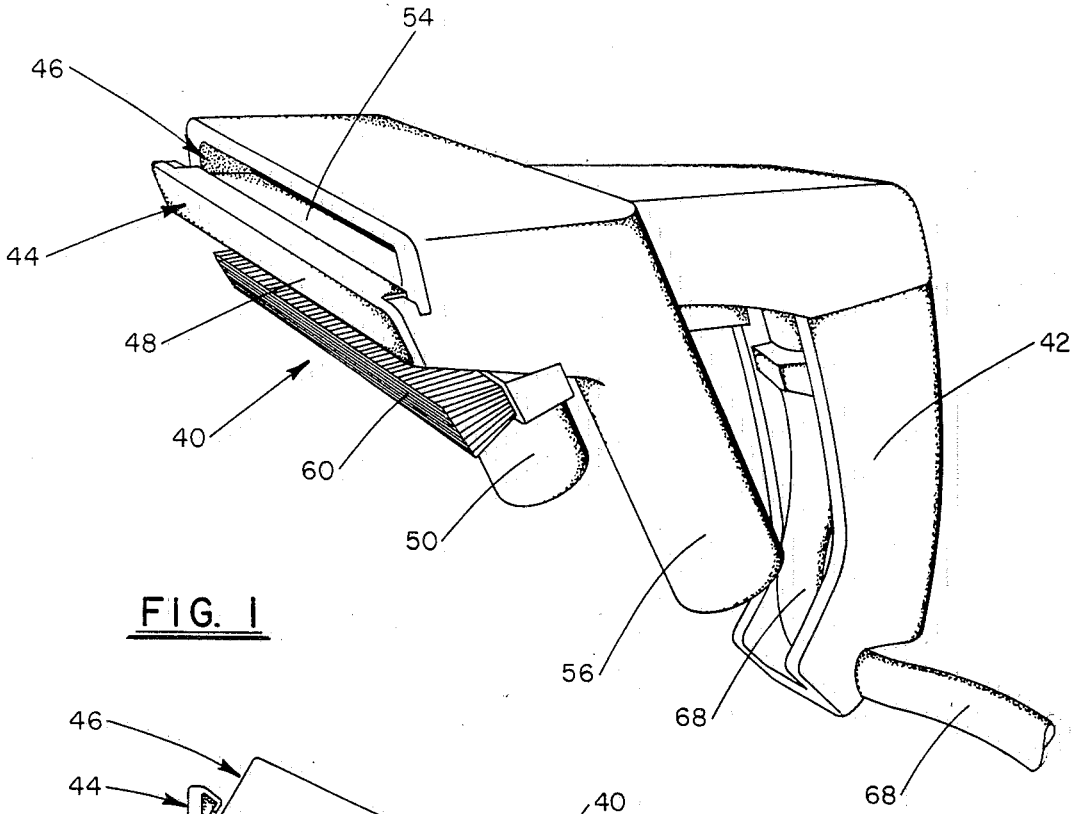
FIG. 1 is a perspective view of the hand applicator of the upholstery cleaning apparatus of the present invention.

With further reference to the drawings, the upholstery cleaning system of the present invention is shown therein and referred to generally by the numeral 10.

Viewing upholstery cleaning system 10 in more detail, it is seen that the same includes a remote unit 12 and a hand-held applicator 40.

Remote unit 12 includes a housing structure 16. Formed within housing structure 16 are a solution supply tank 18 and a recovery tank 20. A variable flow pump 22 is secured to the bottom of supply tank 18. A hose 24 extends from the pump outlet to a quick connect 26 secured to housing structure 16. A blower 28 is secured to the bottom of recovery tank 20. An exhaust hose 30 interconnects the blower exhaust with a hose connect 32 secured to the housing structure 16 adjacent said quick connection 26. An air heating element is disposed within hose connect 32 and is adapted to heat air as the same passes through hose connect 32. Remote unit 12 further includes a air/fluid separating assembly 36 secured within recovery tank 20 and communicatively connected with blower 28. The air/fluid separating assembly is not described in detail as the same is commonly known to those skilled in the art.

Figure 2:
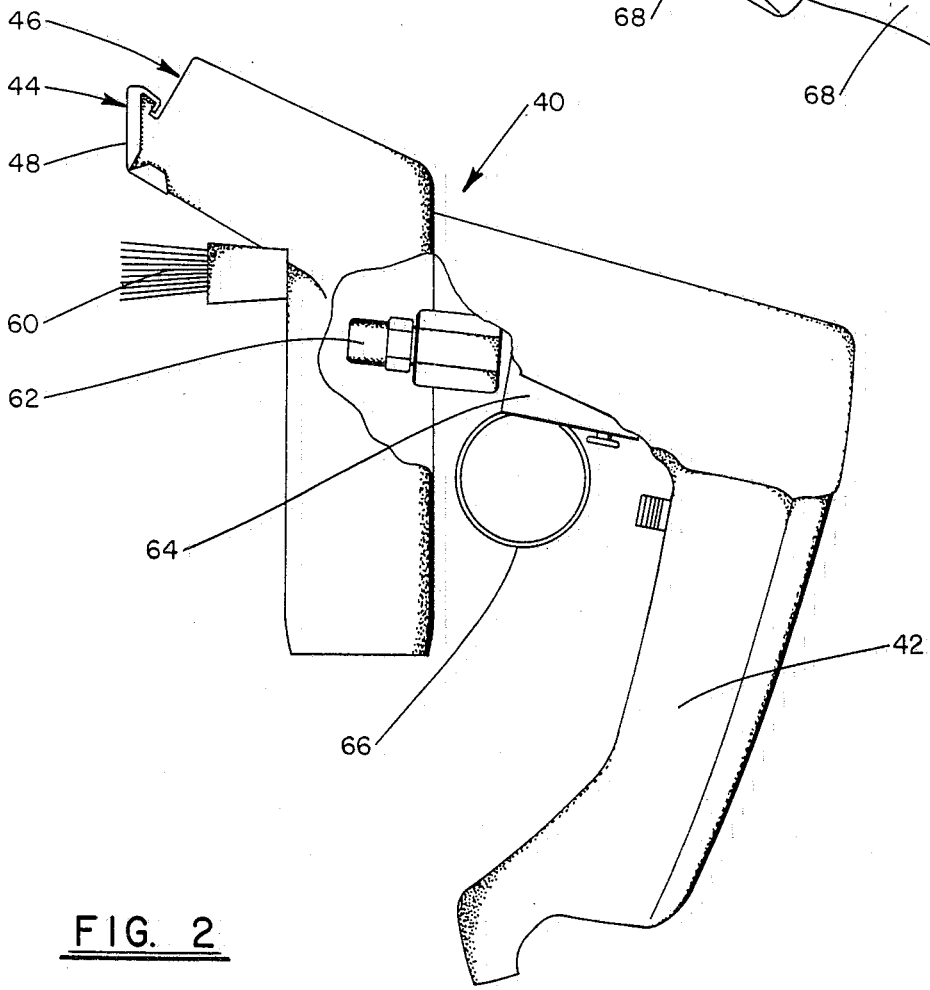
FIG. 2 is a side elevational view of the hand-held applicator shown in FIG. 1.
Figure 3:
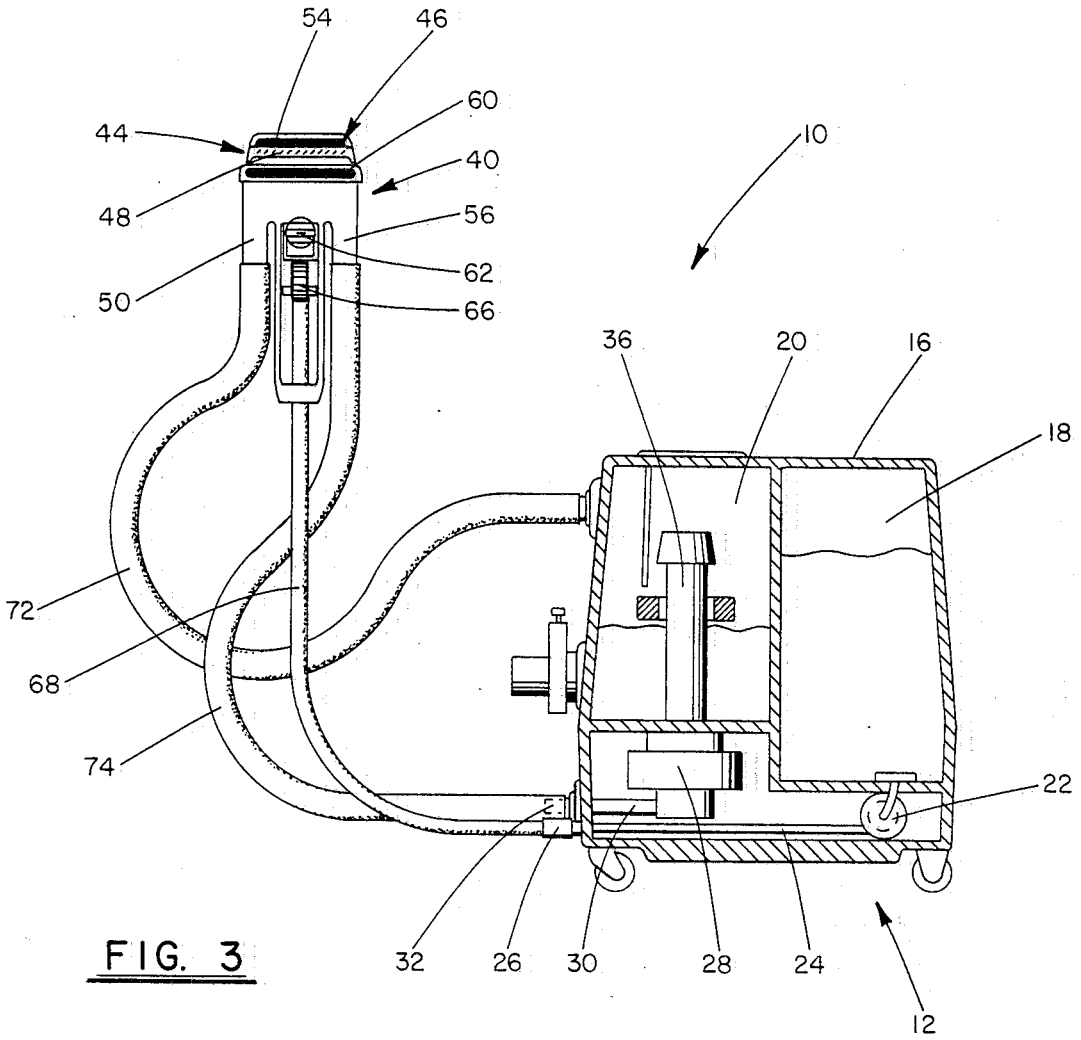
FIG. 3 is a diagrammatic illustration of the upholstery cleaning apparatus of the present invention showing the hand-held applicator and the remote cleaning unit.

A hand-held applicator 40 is used in conjunction with remote unit 12. Applicator 40 includes a handle frame 42 for grasping and controlling the applicator 40. Integrally formed with handle frame 42 are a vacuum head 44 and a dry air manifold 46. The main body of vacuum head 44 and dry air manifold 46 extends forwardly from handle frame 42 with the dry air manifold 46 being disposed adjacent to and on top of vacuum head 44 (see FIGS. 1 and 2). An elongated vacuum inlet 48 is formed in the lower front end of vacuum head 44. A tube-like vacuum outlet 50 extends from the upper rear end of vacuum head 44 adjacent to handle frame 42. A vacuum chamber is formed within vacuum head 44 and communicatively interconnects vacuum inlet 48 and vacuum outlet 50. Likewise, an elongated dry air outlet 54 is formed in the lower front end of dry air manifold 46 adjacent to and above vacuum inlet 48. A tube-like dry air inlet 56 extends from the upper rear end of dry air manifold 46 adjacent to handle frame 42 and opposite of vacuum outlet 50. It is noted that the longitudinal axis of vacuum outlet 50 and dry air inlet 56 are generally parallel. A dry air chamber is formed within dry air manifold 46 and communicatively interconnects dry air outlet 54 and dry air inlet 56.

Applicator 40 further includes an elongated brush 60 secured to said applicator beneath the vacuum head 44 such that the bristles are disposed adjacent to and below vacuum inlet 48. Also, a jet nozzle 62 is secured to handle frame 42 and is disposed between vacuum outlet 50 and dry air inlet 56. Jet nozzle 62 is oriented to spray a fan-shaped spray of cleaning solution downward onto a selected area of upholstery directly behind and adjacent to brush 60. A hand actuated control valve 64 is operatively connected to jet nozzle 62 for controlling the flow of cleaning solution through the same. A trigger 66 is secured to control valve 64 beneath handle frame 42 is to provide finger control means for actuating control valve 64. One end of supply line 68 is connected within control valve 64 by means of an elbow. The supply line 68 extends through the rear of handle frame 42 towards the remote unit 12. The free end of the supply line 68 has a barb fitting which can be easily and quickly connected with the quick connect 26 on remote unit 12. Thus a flow of cleaning solution can be directed from supply tank 18 to jet nozzle 62 where it can be sprayed onto a selected area of upholstery.

Connecting means are also provided with upholstery cleaning system 10 to operatively connect hand-held applicator 40 with remote unit 12. A vacuum hose 72 can be fitted around vacuum outlet 50 and connected with a hose coupling formed in recovery tank 20. Likewise, a blower hose 74 can be fitted around dry air inlet 56 and connected with hose connect 32 on remote unit 12.

In use, hand-held applicator 40 is grasped like a handgun such that the index finger extends through trigger 66. The applicator 40 is pulled across a selected area of upholstery toward the body of the user. As the applicator 40 is pulled toward the user, the trigger 66 is pulled toward handle frame 42 actuating control valve 64. Once actuated, control valve 64 allows cleaning solution to flow from the supply tank 18 to jet nozzle 62. Jet nozzle 62 directs a fan-shaped spray of the solution onto the upholstery directly behind brush 60. As the applicator 40 is continuously pulled to the user, the brush 60 engages the area of upholstery previously sprayed with cleaning solution and massages the same into the upholstery. The vacuum inlet 48 follows directly behind the brush 60 as the applicator is pulled backward. The blower 28 induces air into the vacuum inlet 48 effectively lifting the cleaning solution and associated dirt and debris from the upholstery. Once inside the vacuum chamber, the combined mixture of air and solution is pulled through vacuum outlet 50 and vacuum hose 72 into recovery tank 20. Once inside recovery tank 20, the air/fluid separating assembly 36 separates the cleaning solution from the air. The blower 28 pulls the air from recovery tank 20 and directs the same through exhaust hose 30 towards hose connect 32. Upon reaching hose connect 32, the air is heated to a predetermined temperature and the humidity is reduced to a predetermined level thereby imparting a greater drying capacity to the air. The air continues to flow through hose connect 32 and blower hose 74 into dry air manifold 46. Once inside the dry air chamber of dry air manifold 46, the air is directed through dry air outlet 54 onto the upholstery. It is appreciated that the heated air is expelled onto the upholstery immediately after the cleaning solution is removed therefrom because the applicator 40 is continuously pulled toward the body of the user. Thus, a selected area of upholstery can be cleaned and dryed in a single swath of the hand-held applicator.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An upholstery cleaning system comprising:

A. a hand-held upholstery cleaning applicator including:

a handle frame for graspig and controlling said hand-held applicator;

a jet secured to said handle frame for directing a cleaning solution onto the upholstery;

a hand actuated control valve associated with said jet for controlling the flow of cleaning solution to the same;

an elongated brush mounted on said applicator adjacent said jet for engaging the upholstery and agitating the same after the cleaning solution has been applied by said jet;

a vacuum head formed in said applicator adjacent said brush for lifting cleaning solution and associated dirt and debris from the upholstery, said vacuum head including means defining an elongated vacuum inlet adjacent said brush, a vacuum outlet and a vacuum chamber communicatively interconnecting said vacuum inlet and said vacuum outlet;

a dry air manifold formed in said applicator adjacent said vacuum head for directing heated air onto said upholstery after the cleaning solution is removed therefrom, said dry air manifold including a dry air outlet disposed adjacent said vacuum inlet, a dry air inlet and a dry air chamber communicatively interconnecting said dry air inlet and said dry air outlet;

said vacuum head and said dry air manifold being integrally formed and interconnected with said handle frame;

B. a remote support unit including:

a housing structure having a supply tank for holding cleaning solution prior to directing the same onto the upholstery and a recovery tank for receiving said cleaning solution after the same is removed from the upholstery;

a pump means interconnected within said support unit and associated with said supply tank for directing the cleaning solution from the supply tank to a means defining an outlet;

a blower having an exhaust disposed within said support unit and associated with said recovery tank for moving air from an initial position into said recovery tank and then directing the air out said exhaust;

a heating unit operatively connected with said exhaust of said blower for heating the air directed from said exhaust; and C. connecting means for interconnecting said upholstery applicator and said support unit, said connecting means including:

a solution supply line communicatively interconnected between said outlet and said control valve for carrying said cleaning solution from said outlet to said control valve;

a vacuum hose communicatively interconnected between said recovery tank and said vacuum outlet on said hand-held applicator wherein said vacuum hose effectively interconnects said blower and said vacuum inlet such that said blower induces air into said vacuum inlet effectively picking up a combined mixture of air and cleaning solution and any dirt and soil associated therewith wherein said combined mixture is directed into said recovery tank where said air and cleaning solution are separated; and a blower hose communicatively interconnected between said heating unit and said dry air inlet on said hand-held applicator wherein said blower hose effectively interconnects said exhaust of said blower and said dry air outlet such that said blower directs air from said recovery tank to said dry air outlet where said air is directed onto said upholstery for drying the same, wherein said air is heated as the same passes through said heating unit towards said dry air outlet.

2. The upholstery cleaning system of claim 1 wherein said vacuum head and said dry air manifold each include a main body which extends downwardly and forwardly from said handle frame and wherein said main body of said dry air manifold is adjacent to and above said main body of said vacuum head.

3. The upholstery cleaning system of claim 2 wherein said vacuum outlet and said dry air inlet are formed from a pair of parallel tubes extending from the respective main bodies of said vacuum head and said dry air manifold and wherein said vacuum outlet and said dry air inlet are disposed adjacent to and on opposite sides of said handle frame.

4. The upholstery cleaning system of claim 3 wherein said jet is secured to said handle frame between said vacuum outlet and said dry air inlet and wherein said brush is mounted underneath said main body of said vacuum head.

5. The upholstery cleaning system of claim 4 wherein said control valve includes a trigger secured to the same for actuating said control valve.

6. A hand-held upholstery cleaning applicator for use in combination with a mobile support unit having means supplying a vacuum, means supplying heated air and means supplying a cleaning solution, said hand-held applicator comprising: a handle frame; a jet mounted to said handle frame for directing cleaning solution onto a selected area of upholstery as said hand-held applicator is moved over the same; valve means for controlling the flow of cleaning solution through said jet, wherein said valve means is operatively connected to said means supplying cleaning solution; a brush mounted on said applicator adjacent said jet for engaging the upholstery and agitating the same after the cleaning solution has been applied to a selected area of upholstery by said jet; vacuum means formed in said applicator and connected to said means supply vacuum on said support unit for lifting the cleaning solution and associated dirt and debris from the upholstery; and drying means formed in said applicator and connected to said means supplying heated air on said support unit for directing heated air onto said upholstery for drying the same after the cleaning solution has been removed by said vacuum head means.

7. The hand-held applicator of claim 6 wherein said vacuum means includes a vacuum head having an elongated vacuum inlet disposed adjacent said brush, a vacuum outlet communicatively connected to said vacuum source, and a vacuum chamber extending between and communicatively interconnecting said vacuum inlet and said vacuum outlet such that said vacuum source pulls air into said vacuum chamber through said vacuum inlet effectively lifting the cleaning solution and associated dirt and debris, from a selected area of upholstery after the solution is brushed into the same.

8. The hand-held applicator of claim 7 wherein said drying means includes a dry air manifold having an elongated dry air outlet disposed adjacent said vacuum inlet, a dry air inlet communicatively connected to said means supplying heated air and a dry air chamber extending between and interconnecting said dry air outlet and said dry air inlet such that said heated air is directed into said dry air chamber through said dry air inlet and then out of said dry air outlet onto a selected area of upholstery drying the upholstery after the cleaning solution has been removed by said vacuum means.

9. The hand-held applicator of claim 8 wherein said vacuum head and said dry air manifold are integrally formed with each other and with said handle frame.

10. The hand-held applicator of claim 9 wherein said vacuum head and said dry air manifold each include a main body which extends downwardly from said handle frame such that said main body of said dry air manifold is adjacent to and above said main body of said vacuum head.

11. The hand-held applicator of claim 10 wherein said vacuum outlet and said dry air inlet are formed from a pair of parallel tubes extending rearwardly from the respective main bodies of said vacuum head and said dry air manifold and wherein said vacuum outlet and said dry air inlet are disposed adjacent to and on opposite sides of said handle frame.

12. The hand-held applicator of claim 11 wherein said jet is disposed between said vacuum outlet and said dry air inlet and wherein said brush is mounted underneath said main body of said vacuum head.

13. The hand-held applicator of claim 12 wherein said control valve includes a trigger secured to the same for actuating said control valve.

14. A safe and reasonably effective method of cleaning upholstery using a hand-held applicator and a remote cleaning unit comprising the steps of:

A. directing a cleaning solution from a supply tank on said remote unit to a cut-off valve on said hand-held applicator;

B actuating said cut-off valve and directing the cleaning solution to a jet secured to said hand-held applicator;

C. spraying the cleaning solution through said jet onto said upholstery while making a swath across the upholstery with the hand-held applicator;

D. engaging a brush secured to said hand-held applicator with said upholstery immediately after said cleaning solution is sprayed onto the same;

E brushing the cleaning solution into the upholstery while continuing to move the applicator across the upholstery with the hand-held applicator;

F. passing a vacuum head secured to said hand-held applicator over said upholstery immediately after brushing the same;

G. removing the cleaning solution from the upholstery by inducing air into said vacuum head and effectively picking up a combined mixture of air and cleaning solution while continuing to move the applicator across the upholstery;

H. directing the mixture of air and cleaning solution from the vacuum head to a recovery tank carried by said remote unit;

I. separating the mixture of air and cleaning solution and containerizing the separated cleaning solution in said recovery tank;

J. directing the air from the recovery tank to a drying outlet secured to said hand-held applicator;

K. heating the air between said recovery tank and said drying outlet;

L. passing said drying outlet over the upholstery immediately after removing the cleaning solution from the same;

M. drying the upholstery by directing the heated air from said drying outlet onto the upholstery while continuing to make a swath across the upholstery with the hand-held applicator; and N. repeating the above steps until a selected area of the upholstery has been cleaned.

* * * * *